US007422767B2

(12) United States Patent
Fey et al.

(10) Patent No.: US 7,422,767 B2
(45) Date of Patent: Sep. 9, 2008

(54) PROCESS FOR THE PRODUCTION OF PAINT COATING LAYERS

(75) Inventors: Thomas Fey, Mainz (DE); Oliver Reis, Witten (DE); Carmen Flosbach, Wuppertal (DE); Martin Wulf, Langenfeld (DE); Karl-Friedrich Doessel, Wuppertal (DE)

(73) Assignee: E.I. du Pont de Nemours & Company, Wilmington, DE (US)

( * ) Notice: Subject to any disclaimer, the term of this patent is extended or adjusted under 35 U.S.C. 154(b) by 155 days.

(21) Appl. No.: 11/392,370

(22) Filed: Mar. 29, 2006

(65) Prior Publication Data

US 2006/0165908 A1 Jul. 27, 2006

Related U.S. Application Data

(62) Division of application No. 10/611,731, filed on Jul. 1, 2003.

(60) Provisional application No. 60/419,227, filed on Oct. 17, 2002.

(51) Int. Cl.
*B05D 3/02* (2006.01)

(52) U.S. Cl. ..... 427/148; 427/207.1

(58) Field of Classification Search ..... 427/148, 427/207.1

See application file for complete search history.

(56) References Cited

U.S. PATENT DOCUMENTS

| | | | | |
|---|---|---|---|---|
| 4,061,516 | A | 12/1977 | George et al. | |
| 4,315,790 | A * | 2/1982 | Rattee et al. | 156/230 |
| 5,166,007 | A | 11/1992 | Smith et al. | |
| 5,387,304 | A | 2/1995 | Berner et al. | |
| 5,891,292 | A | 4/1999 | Goodman et al. | |
| 5,912,081 | A | 6/1999 | Negele et al. | |
| 6,221,439 | B1 | 4/2001 | Negele et al. | |
| 6,551,432 | B1 * | 4/2003 | Spain et al. | 156/230 |

FOREIGN PATENT DOCUMENTS

| | | | |
|---|---|---|---|
| DE | 19654918 | A1 | 1/1998 |
| EP | 141796 | | 5/1985 |
| EP | 0251546 | A2 | 6/1987 |
| EP | 0361351 | A2 | 9/1989 |
| EP | 0578886 | A1 | 1/1994 |
| EP | 0837109 | A2 | 4/1998 |
| EP | 1308219 | A2 | 5/2003 |
| JP | 60-068082 | | 4/1985 |
| JP | 60-068083 | | 4/1985 |
| WO | WO 95/02461 | | 1/1995 |
| WO | WO 96/40480 | | 12/1996 |
| WO | WO 98/29237 | | 7/1998 |
| WO | WO 00/08093 | | 2/2000 |
| WO | WO 00/08094 | | 2/2000 |
| WO | WO 00/63015 | | 10/2000 |
| WO | WO 0078847 | A2 | 12/2000 |

OTHER PUBLICATIONS

European Patent Office Article 96(2) Communication, Application No. EP 03022371.

Goldschmidt A. & H.J. Streitberger. BASF Handbook on Basics of Coating Technology. Hanover, Germany, Vincentz Network, 2003. p. 689).

* cited by examiner

*Primary Examiner*—Erma Cameron
(74) *Attorney, Agent, or Firm*—Joachim Blum

(57) ABSTRACT

A process for the production of a coating layer from a thermally curable coating composition on a substrate, comprising the successive steps:

a) providing a substrate to be coated, b) applying a backing foil coated on one side with an uncured or at least only partially cured coating layer of a thermally curable coating composition, with its coated side on the entire surface or at least one sub-zone of the surface of the substrate, c) supplying thermal energy onto the entire coating applied in step b), and d) removing the backing foil from the coating which remains on the substrate;

wherein the supply of thermal energy onto the coating proceeds prior to and/or after removal of the backing foil.

10 Claims, No Drawings

PROCESS FOR THE PRODUCTION OF PAINT COATING LAYERS

CROSS-REFERENCE TO RELATED APPLICATIONS

This application is a divisional of U.S. patent application Ser. No. 10/611,731 filed Jul. 1, 2003, now pending, which claims priority from U.S. Provisional Application Ser. No. 60/419,227 filed on Oct. 17, 2002, each of which is hereby incorporated by reference in their entireties.

FIELD OF THE INVENTION

The invention relates to a process for the production of paint coating layers from a thermally curable coating composition, in particular, in the form of an outer coating layer of a multi-layer coating. The process may in particular find application in automotive and industrial coating.

BACKGROUND OF THE INVENTION

It is known to use thermally curable coating compositions in automotive coating. Coating compositions based on free-radically and/or cationically polymerizable binders or on binders which crosslink by means of condensation and/or addition reactions are for example used in such applications.

Prior art processes are known in which coated foils are applied onto the substrate, for example, an automotive body. The foils may here be provided on one side with one or more coating layers and may have on the same or the other side an adhesive layer so that the foil can be fixed to the substrate. Where appropriate binders are used, the coating and/or adhesive layers may also be cured by ultraviolet light (UV) radiation. Such foils and corresponding application processes are described, for example, in WO-A-00/08093, WO-A-00/08094, WO-A-00/63015, EP-A-251 546 and EP-A-361 351. In general, the foil is laminated onto the substrate, where it remains fixed to the substrate.

DE-A-196 54 918, U.S. Pat. Nos. 5,912,081 and 6,221,439 describe coating foils which are so-called free coating films. The coating foils comprise an adhesive layer and at least one coating layer. It is possible to dispense with a stabilizing backing foil in these cases.

WO 00/78847 describes free foils, which once applied onto appropriate substrate surfaces, are heated and/or irradiated with actinic radiation; the nature of the foils is described by means of physical parameters, while the material composition thereof remains largely unexplained. The physical behaviour of the foils may be adjusted by, for example, incorporating components into conventional and known foils, which components, on the one hand, act as plasticizers and, on the other, may be cured with actinic radiation or be removed from the foil, for example by vaporization.

It is desirable to find a way to be able to apply coatings of thermally curable coating compositions without using conventional types of application, such as, for example, spray application. The use of adhesive layers or of backing layers, such as, for example, backing foils, which remain on the substrate should also be avoided.

SUMMARY OF THE INVENTION

The process according to the invention provides a process for the production of a paint coating layer, in particular, in the form of an outer coating layer of a multi-layer coating, wherein the coating layer is applied from a thermally curable coating composition while avoiding spray application, no separate adhesive layer is used and the finished coating also does not comprise a backing layer, such as, for example, a foil, as a constituent. As a result, the substrate, in particular, a substrate provided with any desired precoating, is coated only with an additional coating layer applied from a thermally curable coating composition and thermally cured.

The invention relates to a process for the production of a paint coating layer from a thermally curable coating composition, in particular, in the form of an outer coating layer of a multi-layer coating, comprising the following successive steps:

a) providing a substrate to be coated, in particular a substrate provided with a one-layer or multi-layer precoating, b) applying a backing foil coated on one side with an uncured or at least only partially cured coating layer of a thermally curable coating composition, with its coated side on the entire surface or at least one sub-zone of the surface of the substrate, c) supplying thermal energy to the entire coating applied in step b), and d) removing the backing foil from the coating which remains on the substrate;

wherein the supply of thermal energy onto the coating proceeds prior to and/or after removal of the backing foil.

DETAILED DESCRIPTION OF THE EMBODIMENTS

Steps c) and d) are preferably performed in such a manner that the supply of thermal energy proceeds prior to the removal of the backing foil, for example, through the backing foil, or after removal of the backing foil. It is also possible, but less preferred, to supply only a portion of the thermal energy to the coating prior to the removal of the backing foil, then to remove the backing foil and thereafter to supply the still missing portion of the thermal energy.

The term "supply of thermal energy" as used herein excludes UV irradiation and electron beam irradiation.

For brevity's sake, the term "coating layer" is used below and in the claims instead of the term "paint coating layer".

The individual steps of the process according to the invention are explained in greater detail below.

Step a) of the process according to the invention consists in the provision of a substrate to be coated. Substrates which may be considered for coating are any desired objects, of which the surface [sub-zone(s)] to be coated is/are accessible to the application of a coated backing foil according to step b) and to the supply of thermal energy. These may, for example, comprise industrially or workshop produced objects made from any desired materials, such as, for example, metal, plastics, fibre-reinforced plastic or wood. Further possible objects are those that have been assembled from two or more different materials by composite construction to form a single structure to be coated. Preferred examples of substrates to be provided with a coating layer in the process according to the invention are any desired industrially produced goods, in particular, automotive bodies, body parts or body fittings.

The substrates may be uncoated or in particular be provided with a one-layer or multi-layer precoating. Examples of one-layer precoatings are primer coating layers, which are provided in the process according to the invention with an outer, opaque coating layer or coating layers that are provided in the process according to the invention with an outer, transparent coating layer. Examples of multi-layer precoatings are multi-layer coatings consisting of primer and surfacer, which are provided in the process according to the invention with an outer, opaque coating layer, but in particular multi-layer coatings consisting of primer and top coat which are provided in the process according to the invention with an outer coating layer. Examples of multi-layer coatings consisting of primer and top coat are, for example, coating structures known from the automotive coating sector comprising electrodeposited primer, optionally, surfacer or surfacer substitute layer and one-layer top coat or, instead of the one-layer top coat, a two-layer top coat comprising a color- and/or special effect-imparting base coat layer and a clear coat layer applied thereon. The outer coating layer applied by the process according to the invention may have the most varied purposes, some of which are stated below by way of example, in particular, the outer coating layer may, depending upon the chemical composition thereof, be applied as a transparent sealing layer providing protection against the most varied external influences.

In step b) of the process according to the invention, a backing foil coated on one side with an uncured or at least only partially cured coating layer of a thermally curable coating composition is applied with its coated side on the entire surface or on at least one sub-zone of the surface of the substrate.

The backing foil comprises metal foils, such as aluminium foil, or foils made from any desired plastics, in particular thermoplastics. The plastics foils are preferably transparent, in particular colorless and transparent. In the case of the embodiment of supplying thermal energy prior to the removal of the backing foil the plastics foils must be resistant to the temperatures that arise in the foil material on supply of thermal energy. The foils must also be resistant to the temperatures optionally required for partially gelling/tackifying the applied coating layer. Suitable plastics foil materials are, for example, polyolefins, such as, polyethylene, polypropylene; polyurethane; polyamide and polyesters, such as, polyethylene terephthalate and polybutylene terephthalate. The plastics foils may also consist of polymer blends.

The backing foils may be surface-treated. It is also possible for the backing foils to have a textured surface, for example, a micro- and/or macro-textured surface. A textured foil surface, for example, is convenient if the surface of the coating layer to be applied in the process according to the invention is to exhibit corresponding textures. In this case, the side of the backing foil to be coated would comprise a negative of the appropriate textures and, after removal of the textured backing foil, the textures may then be formed as a positive in the outer surface of the outer coating layer produced using the process according to the invention. The thickness of the foils may, for example, be between 10 and 1000 μm, preferably, between 10 and 500 μm, particularly preferably, between 20 and 250 μm and is determined by practical considerations of processability.

The backing foils selected should preferably be those that are elastic and extensible and cling effectively to the substrate by electrostatic forces.

The backing foils are coated on one side with liquid or pasty thermally curable coating compositions. The coating compositions may be aqueous, diluted with solvents or contain neither solvents nor water. The thermally curable coating compositions are the coatings known to the person skilled in the art that contain binders curable by means of cationic and/or free-radical polymerization and/or binders curable by means of condensation reactions and/or addition reactions. When selecting the binders, care must be taken to use only those thermally cross-linkable binders that are stable in storage prior to supply of thermal energy.

Cationically curable coating compositions that are to be applied onto the backing foil contain one or more cationically polymerizable binders. These may comprise conventional binders known to the person skilled in the art, such as, polyfunctional epoxy oligomers containing more than two epoxy groups per molecule. These comprise, for example, polyalkylene glycol diglycidyl ethers, hydrogenated bisphenol A glycidyl ethers, epoxyurethane resins, glycerol triglycidyl ether, diglycidyl hexahydrophthalate, diglycidyl esters of dimer acids, epoxidized derivatives of (methyl)cyclohexene, such as, for example, 3,4-epoxycyclohexylmethyl(3,4-epoxycyclohexane)carboxylate or epoxidized polybutadiene. The number average molar mass of the polyepoxy compounds is preferably below 10,000. Reactive diluents, such as, cyclohexene oxide, butene oxide, butanediol diglycidyl ether or hexanediol diglycidyl ether, may also be used.

The cationically curable coating compositions contain one or more thermally activatable initiators. Initiators which may be used are, for example, thermolabile onium salts.

Free-radically curable coating compositions that are to be applied onto the backing foil contain one or more binders with free-radically polymerizable olefinic double bonds. Suitable binders having free-radically polymerizable olefinic double bonds that may be considered are, for example, all the binders known to the skilled person that can be cross-linked by free-radical polymerization. These binders are prepolymers, such as, polymers and oligomers containing, per molecule, one or more, preferably on average 2 to 20, particularly preferably 3 to 10 free-radically polymerizable olefinic double bonds. The polymerizable double bonds may, for example, be present in the form of (meth)acryloyl, vinyl, allyl, maleate and/or fumarate groups. The free-radically polymerizable double bonds are particularly preferably present in the form of (meth)acryloyl groups.

Both here and below, (meth)acryloyl or (meth)acrylic are respectively intended to mean acryloyl and/or methacryloyl or acrylic and/or methacrylic.

Examples of prepolymers or oligomers include (meth) acryloyl-functional poly(meth)acrylates, polyurethane (meth)acrylates, polyester(meth)acrylates, unsaturated polyesters, polyether(meth)acrylates, silicone(meth)acrylates, epoxy(meth)acrylates, amino(meth)acrylates and melamine (meth)acrylates. The number average molar mass Mn of these compounds may be, for example, 500 to 10,000 g/mole, preferably 500 to 5,000 g/mole. The binders may be used individually or as a mixture. (Meth)acryloyl-functional poly (meth)acrylates and/or polyurethane(meth)acrylates are preferably used.

The prepolymers may be used in combination with reactive diluents, i.e., free-radically polymerizable low molecular weight compounds with a molar mass of below 500 g/mole. The reactive diluents may be mono-, di- or polyunsaturated. Examples of monounsaturated reactive diluents include: (meth)acrylic acid and esters thereof, maleic acid and semi-esters thereof, vinyl acetate, vinyl ethers, substituted vinylureas, styrene, vinyltoluene. Examples of diunsaturated reactive diluents include: di(meth)acrylates, such as, polyethylene glycol di(meth)acrylate, 1,3-butanediol di(meth)acrylate, vinyl(meth)acrylate, allyl(meth)acrylate, divinylbenzene, dipropylene glycol di(meth)acrylate and hexanediol di(meth)acrylate. Examples of polyunsaturated reactive diluents are: glycerol tri(meth)acrylate, trimethylolpropane tri (meth)acrylate and pentaerythritol tri(meth)acrylate, pentaerythritol tetra(meth)acrylate. The reactive diluents may be used alone or in mixture.

The free-radically curable coating compositions may contain thermally activatable free-radical initiators which decompose at different temperatures, depending on the initiator type. Examples of such free-radical initiators include, organic peroxides, organic azo compounds or C—C-cleaving initiators, such as, dialkyl peroxides, peroxycarboxylic acids, peroxydicarbonates, peroxide esters, hydroperoxides, ketone peroxides, azodinitriles or benzopinacole silyl ethers. The free-radical initiators are preferably used in quantities of between 0.1 and 5 wt-%, relative to resin solids content. The thermal initiators may be used individually or in combination.

Thermally curable coating compositions that cure by means of condensation reactions and/or by means of addition reactions and are to be applied onto the backing foil contain one or more binders with appropriately cross-linkable functional groups. Suitable binders are those binders or binder systems that are stable in storage prior to supply of thermal energy. One-component binder systems are preferred.

The addition and/or condensation reactions as stated above comprise coatings chemistry cross-linking reactions known to the person skilled in the art, such as, ring-opening addition of an epoxy group onto a carboxyl group forming an ester and a hydroxyl group, the reaction of a hydroxyl group with a blocked isocyanate group forming a urethane group and eliminating the blocking agent, the reaction of a hydroxyl group with an N-methylol group eliminating water, the reaction of a hydroxyl group with an N-methylol ether group eliminating the etherification alcohol, the transesterification reaction of a hydroxyl group with an ester group eliminating the esterification alcohol, the transurethanization reaction of a hydroxyl group with a carbamate group eliminating alcohol, the reaction of a carbamate group with an N-methylol ether group eliminating the etherification alcohol. Moisture-curing binder components are also possible, for example, compounds with free isocyanate groups, with hydrolyzable alkoxysilane groups or with ketimine- or aldimine-blocked amino groups. In the event that the coating compositions contain binders or functional groups that cure by means of atmospheric humidity, certain conditions must be maintained during preparation of the coated backing foils in order to avoid premature curing. This issue is addressed in greater detail below in the description of the form of the coated backing foil.

The various cross-linking mechanisms described above may be combined at will, provided that they do not mutually interfere. The various cross-linkable functional groups may here be present in the same binder and/or in separate binders.

Binders that cross-link without elimination are preferably used in the process according to the invention. In particular, free-radically polymerizable binder systems are used in combination with thermal initiators. These binder systems may optionally be combined with at least one of the above-stated binder systems which cross-link by means of condensation and/or addition reactions.

The coating compositions that may be used for coating the backing foil may be pigmented or un-pigmented coating compositions. Un-pigmented coating compositions are, for example, coating compositions formulated in conventional manner as clear coats. Pigmented coating compositions contain color-imparting and/or special effect-imparting pigments. Suitable color-imparting pigments are any conventional coating pigments of an organic or inorganic nature. Examples of inorganic or organic color-imparting pigments are titanium dioxide, micronized titanium dioxide, iron oxide pigments, carbon black, azo pigments, phthalocyanine pigments, quinacridone or pyrrolopyrrole pigments. Examples of special effect-imparting pigments are metal pigments, for example, made from aluminium or copper; interference pigments, such as, metal oxide coated metal pigments, titanium dioxide coated mica.

The coating compositions may also contain transparent pigments, soluble dyes and/or extenders. Examples of usable extenders are silicon dioxide, aluminium silicate, barium sulfate, calcium carbonate and talc.

The coating compositions may also contain conventional coating additives. Examples of conventional coating additives include levelling agents, rheological agents, such as, highly disperse silica or polymeric urea compounds, thickeners, for example, based on partially cross-linked, carboxy-functional polymers or on polyurethanes, defoamers, wetting agents, anticratering agents, catalysts, antioxidants and light stabilizers based on HALS (hindered amine light stabilizer) products, sterically hindered morpholin-2-one derivatives, in particular, morpholin-2-one derivatives sterically hindered by 3,3,5,5 polysubstitution and/or UV absorbers. The additives are used in conventional amounts known to the person skilled in the art.

The coating compositions may contain water and/or organic solvents conventional in coatings and known to the person skilled in the art.

The thermally curably coating compositions may be applied onto the backing foil by conventional methods, for example, by brushing, roller coating, pouring, blade coating or spraying. The coating composition may be applied as a melt or in the liquid phase, for example, as a solution. The coating compositions may, for example, be blade coated as a solution. In the subsequent drying process, the solvent is allowed to evaporate, optionally, with gentle heating. The coating must in no event be completely cross-linked during the drying process. The dried, uncross-linked coating should advantageously be at least slightly tacky at room temperature in order to ensure good adhesion onto the substrate. The coating may either be intrinsically tacky, for example, due to specially formulated binders or tackiness may be achieved by slight partial cross-linking/gelling of the dried coating, for example, by gentle heating. The thermally curable coating compositions are generally applied in a layer thickness of 1 to 100 μm, preferably of 5 to 60 μm.

It may be advantageous to apply the coating with a layer thickness that reduces towards the edges of the backing foil so that, when it is subsequently applied, edge marks on the substrate surface are avoided.

In order to facilitate subsequent removal of the backing foil prior to or after the supply of thermal energy onto the coating, it may be advantageous to leave at least one edge zone of the backing foil uncoated. It may also be advantageous to provide a special finish on the side of the backing foil that is to be coated, for example, a release coating, or to use special surface-treated foils, for example, foils surface-modified with silicate layers, in order, on removal of the backing foil, to facilitate detachment from the coating that is fixed to the substrate.

It may also be advantageous to provide the coated backing foil with a temporary protective foil to provide protection. The protective foil may here be present only on the coated side of the backing foil, but it may also be applied onto both sides and completely enclose the entire coated backing foil. The latter possibility would in particular be advisable in the event of presence of the above-described moisture-curing binder or functional groups in order to exclude atmospheric humidity. In order to facilitate detachment of the protective foil, it too may be provided with non-stick properties, as described above.

The coated backing foils, optionally provided with protective foil or protective envelope, may be prefabricated and stored in the most varied shapes and sizes, for example, in sizes of 0.5 $cm^2$ to 2 $m^2$. The coated backing foils may also be stored as a reel of continuous foil.

The coated backing foils may be cut into pieces of the correct size adapted to the coating task before use for the production of the coating on the substrate or they are already correctly dimensioned, for example, in the form of a set of coated backing foils cut to fit the surface [sub-zone(s)] of the substrate in question.

After removal of an optionally present protective foil or protective sleeve, the coated backing foil is placed with its coated side on the entire surface or at least one sub-zone of the surface of the substrate.

Whether it is the entire surface or only at least one sub-zone of the surface of the substrate that are to be coated with the coating layer is determined by the nature of the substrate and/or by the task to be performed by the coating layer produced using the process according to the invention. If the entire surface of a substrate is accessible to the application of a coated backing foil according to step b) and to the supply of thermal energy, there are no restrictions determined by the substrate and the entire substrate surface can be provided with the coating layer using the process according to the invention. In the case of three-dimensional substrates of a complicated shape, especially those having cavities and undercuts, such as, for example, automotive bodies, it is not possible to provide the entire surface with a coating layer using the process according to the invention and use of the process according to the invention is limited to those surface zones that are accessible to the application of a coated backing foil according to step b) and to the supply of thermal energy.

Depending upon the task to be performed by the coating layer produced using the process according to the invention, it may be desired to coat the entire surface or only at least one sub-zone of the surface of a substrate. The phrase "at least one sub-zone of the surface of a substrate" does not mean only "one or more surface zones of a substrate accessible to the application of a coated backing foil according to step b) and to the supply of thermal energy", but in particular also includes just one or more sub-areas of those surface zones that are accessible to the application of a coated backing foil according to step b) and to the supply of thermal energy.

Examples of one or more tasks that the outer coating layer produced using the process according to the invention may simultaneously perform are the provision of a) optical properties, such as, imparting a certain degree of gloss, for example, provision of matt, silk or high-gloss surfaces (which may for example be achieved by using a coated backing foil which has or lacks a corresponding texture of its surface located beneath the coating), providing a decorative effect, for example, providing a colored surface and/or a surface exhibiting effects dependent upon the angle of observation (may be achieved by appropriate pigmentation of the coating located on the backing foil), providing a surface exhibiting interference phenomena (may be achieved by using a coated backing foil which exhibits a corresponding texture of its surface located beneath the coating), and/or b) technical properties, such as, acid resistance, chemical resistance, scratch resistance, low soiling tendency, for example, anti-graffiti properties, self-cleaning effect, for example, in rain.

While, as the person skilled in the art is aware, resistance to acids, chemicals and scratching and a low soiling tendency are substantially determined by the chemical composition of the thermally curable coating composition which has been applied onto the backing foil, the self-cleaning effect may also be achieved by an appropriate texture of the side of the backing foil beneath the coating, wherein the texture is a negative of a self-cleaning surface texture. Self-cleaning surface textures are known to the person skilled in the art from the Lotus Effect®, which has recently been the subject of considerable discussion, or for example from EP-B-0 772 514.

When only sub-zones of the surface of a substrate are coated using the process according to the invention, it is up to the user to decide which sub-zones of the surface are to be provided with a coating layer using the process according to the invention and which are not. This may be illustrated by way of example by the application of a transparent sealing coat layer, in this case for scratch protection purposes, onto an automotive body provided with a precoating in the form of a per se complete multi-layer coating comprising an electrodeposited primer, surfacer coat, base coat and clear coat. The transparent sealing coat layer may then actually be applied using the process according to the invention onto areas of the body that are exposed to a particular risk of scratching in service. Examples of areas of a motor vehicle which are at particular risk of scratching in service are the areas around the locks or door handles together with loading areas or door openings, in particular for example where sills jut out beneath door openings, which are at particular risk of scratching when occupants get into or out of the vehicle. Further examples of areas of an automotive body that are at risk of scratching are areas which are suitable for accommodating external loads, for example, the roof or hatchback.

The coated backing foils are applied by lamination, preferably under pressure and optionally with heating and the coating is thus attached to the substrate. This may in particular be achieved by using devices known from laminate production which have optionally been suitably modified, for example, with a heatable roll, for example, a rubber roll.

Once the coated backing foil has been applied with its coated side onto the surface [sub-zone(s)] of the substrate to be provided with the coating layer, the entire coating layer so applied is supplied with thermal energy. Thermal energy may be supplied prior to and/or after the removal of the backing foil. When thermal energy is supplied prior to the removal of the backing foil, this supply of thermal energy may, for example, proceed through the backing foil. When using systems comprising binders cross-linkable by means of condensation reactions, thermal energy is advantageously supplied only once the backing foil has been removed since the elimination products arising during the cross-linking reaction may otherwise be disruptive.

Thermal energy (heat) may be supplied to the coating in various ways, in each case providing a temperature in the coating for a period of time sufficient to cure (crosslink) the coating. The person skilled in the art knows or knows how to determine and how to provide the temperature/time conditions required for cross-linking the various thermally curable coating systems. Supply of thermal energy according to process step c) may proceed using a single method or a combination of two or more conventional methods, for example, by radiant heating by means of infrared and/or near infrared irradiation and/or by convection, for example, by means of hot air and/or by induction heating (in the case of metallic substrates) and/or by contact heating, for example, using a heatable heat-transfer means, such as, a heatable roller or plate which is applied or laid directly on the uncoated outer side of the coated backing foil.

Conventional infrared radiation emitters and near infrared radiation emitters may be considered as radiation sources for the infrared irradiation and near infrared irradiation. The infrared radiation emitters preferably comprise infrared radiation emitters that emit radiation in the short wavelength infrared range, for example, between 0.8 and 2 μm, or infrared radiation emitters that emit radiation in the medium wavelength infrared range, for example, between 2 and 4 μm. The infrared radiation emitter(s) may be positioned in front of the substrate surface to be irradiated, for example, at a distance of 20 to 70 cm. The irradiation time with infrared radiation may amount, for example, to 1 to 30 minutes.

The near infrared radiation emitters comprise such radiation emitters which emit short wavelength infrared radiation of the wavelength range from approximately 760 to approximately 1500 nm; preferably, 760 to 1200 nm. Such NIR radiation emitters are commercially available from Adphos. They are, for example, high-performance halogen radiation emitters with an intensity (radiation output per unit area) of generally greater than 10 $kW/m^2$ to, for example, 15 $MW/m^2$, preferably, between 100 $kW/m^2$ and 800 $kW/m^2$. For example, the radiation emitters reach a radiation emitter surface temperature (coil filament temperature) of more than 2000 K, preferably, more than 2900 K, for example, a temperature from 2000 to 3500 K. Suitable radiation emitters have, for example, an emission spectrum with a maximum between 750 and 1200 nm.

The distance between the object and NIR radiation emitter may be, for example, 2 to 60 cm, the irradiation time may be, for example, from 1 to 300 s. The irradiation time refers either to the duration of continuous irradiation or to the sum of the periods of different irradiation cycles. By selecting the various parameters in a controlled manner, different surface temperatures may be obtained, for example, surface temperatures from 80 to 250° C. The surface temperatures also may, however, be over 250° C.

When supplying thermal energy prior to the removal of the backing foil, the foil is removed after the energy has been supplied. To this end, the coating is advantageously first allowed to cool before the foil is removed.

One embodiment of the invention consists in effecting a partial cure of the coating by initially supplying thermal energy prior to the removal of the backing foil and, once the foil has been removed, effecting final curing in a second energy supply step. In other words, the dose of thermal energy required for complete cure is supplied in at least two separate steps.

While the process according to the invention relates to the production of external coating layers, it is, of course, also possible in principle, subject to appropriate adaptation of the process, to use the coated backing foils for the production of primer or intermediate layers in multi-layer coatings.

The process according to the invention is in particular suitable for the production of outer coating layers in industrial and automotive coating and, in the case of automotive coating, is not restricted to industrial automotive coating, but also includes use in automotive repair facilities, for example, for the purpose of subsequently providing the entire surface or one or more sub-zones of the surface of an automotive substrate with an outer coating layer.

As mentioned above, the process according to the invention may be used in many different sectors for the production of outer coating layers on the entire surface or at least one sub-zone of the surface of the most varied substrates. As likewise already explained above, the coating layers may perform many different tasks. Conventional application methods, such as, in particular, spraying, and the associated disadvantages are avoided. For example, there is no overspray and, in particular when only sub-zones of the surface are being coated, masking or masking templates are not required for the surface zones which are not to be coated, since the coating layer produced in the process according to the invention is already present in the desired size on the backing foil and is transferred from said backing foil onto the substrate to be coated or the sub-zone(s) thereof which are to be coated.

The following example is intended to illustrate the invention in greater detail.

EXAMPLE pbw=parts by weight wt-%=weight-%

Production of a Coated Backing Foil:

A free-radically polymerizable polyurethane resin was first produced as follows:

369.4 pbw of isophorone diisocyanate were combined with 0.6 pbw of methylhydroquinone and 80 pbw of butyl acetate and heated to 80° C. A mixture of 193 pbw of hydroxyethyl acrylate and 0.5 pbw of dibutyltin dilaurate was added dropwise in such a manner that the reaction temperature did not rise above 100° C. 50 pbw of butyl acetate were used to rinse out the dropping funnel. The temperature was maintained at a maximum of 100° C. until an NCO-value of 10.1 was obtained. 300 pbw of a polycaprolactone triol (Capa 305 from Interox Chemicals) and 50 pbw of butyl acetate were then added. The reaction mixture was maintained at a maximum of 100° C. until an NCO-value of <0.5 was obtained. The mixture was then diluted with 69.6 pbw of butyl acetate. A colorless, highly viscous resin with a solids content of 75 wt-% (1 h/150° C.) and a viscosity of 10,000 mPas was obtained.

A thermally curable clear coat was then produced from the following constituents:

80.8 wt-% of the acryloyl-functional polyurethane resin produced above 1.3 wt-% of a commercially available thermolabile peroxide free-radical initiator (Trigonox® 21 from Akzo), 0.1 wt-% of a conventional commercial levelling agent (Ebecryl® 350/UCB)

0.8 wt-% of a conventional commercial UV absorber (Tinuvin® 384/CIBA)

0.8 wt-% of a conventional commercial light stabilizer (HALS based) (Tinuvin® 292/CIBA)

16.2 wt-% of butyl acetate.

The resultant clear coat was then applied onto a backing foil. To this end, the clear coat was blade coated to a dry layer thickness of 40 μm onto one side of a 20 μm thick polyester foil. The applied clear coat layer was dried for 10 minutes at 60° C. to evaporate the solvent. A slightly tacky, no longer flowable surface was obtained.

Application of the Coated Backing Foil

Variant 1: An appropriate piece (20 cm×15 cm) of the above-coated foil was placed with its coated side down onto one half of a 20 cm×30 cm metal test panel which had been coated with a typical automotive multi-layer coating comprising electrodeposited primer, surfacer coat, base coat and clear coat.

The coating layer was then heated through the foil with an IR radiation emitter to approximately 80° C. and laminated without bubbles under gentle pressure. The still warm and softened coating material was then irradiated through the backing foil for 6 seconds and cured by means of a conventional commercial near infrared radiation emitter (400 $kW/m^2$, 100% power, High-burn-emitter of Adphos) at a distance of 20 cm. The foil was then peeled off. The half of the surface sealed with the coating layer which had been transferred from the backing foil onto the multi-layer coating and cured was distinguished by elevated scratch and acid resistance in comparison with the unsealed half.

Variant 2: Variant 1 was repeated except that after lamination the still warm and softened coating material was irradiated through the foil for 20 minutes and cured by means of a conventional commercial infrared radiation emitter (emission spectrum maximum: 2.4 μm; 20 $kW/m^2$; Heraeus) at a distance of 40 cm. The foil was then peeled off. The half of the surface sealed with the coating layer which had been transferred from the backing foil onto the multi-layer coating and cured was distinguished by elevated scratch and acid resistance in comparison with the unsealed half.

What is claimed is:

1. A process for the production of a coating layer from a thermally curable coating composition on a substrate, comprising the successive steps:

a) providing a substrate to be coated, wherein the substrate is an automotive body;

b) applying a coated backing foil consisting of a foil coated on one side with an uncured or at least partially cured coating layer of a thermally curable coating composition, with its coated side on the entire surface or on at least one sub-zone of the surface of the substrate;

c) removing the backing foil from the coating which remains on the substrate; and d) supplying energy consisting of thermal energy onto the entire coating applied in step b).

2. The process of claim 1, wherein the substrate to be coated is provided with a precoating comprising at least one layer.

3. The process of claim 1, wherein the surface of the backing foil in adherence with the coating is textured.

4. The process of claim 1, wherein the uncured or at least only partially cured coating layer in step b) is a coating layer with a tacky surface.

5. The process of claim 1, wherein the thermally curable coating composition applied in step b) contains at least one binder cross-linkable by reactions selected from the group consisting of condensation reactions, addition reactions and combinations thereof.

6. The process of claim 1, wherein the coated backing foil is applied in step b) with pressure.

7. The process of claim 1, wherein the coated backing foil is applied in step b) with pressure and heat.

8. The process of claim 1, wherein the supply of thermal energy proceeds in step c) by using a method selected from the group consisting of radiant heating, convection, induction heating, contact heating and any combination thereof.

9. The process of claim 1, wherein the coating composition is applied in step b) as a transparent sealing coating composition.

10. The process of claim 9, wherein the transparent sealing coating composition is applied onto one or more sub-zone(s) of the surface of the substrate which sub-zone(s) are accessible to the application of a coated backing foil according to step b) and to supply of thermal energy.

* * * * *